United States Patent [19]

Aboelfotoh et al.

[11] 4,340,840

[45] Jul. 20, 1982

[54] DC GAS DISCHARGE DISPLAY PANEL WITH INTERNAL MEMORY

[75] Inventors: Mohamed O. Aboelfotoh, Poughkeepsie; Marvin B. Skolnik, Kingston, both of N.Y.

[73] Assignee: International Business Machines Corporation, Armonk, N.Y.

[21] Appl. No.: 142,564

[22] Filed: Apr. 21, 1980

[51] Int. Cl.[3] ..... H01J 61/56

[52] U.S. Cl. ..... 315/58; 313/188; 313/218; 315/169.4

[58] Field of Search ..... 315/58, 169.4; 313/188, 313/217, 218

[56] References Cited

U.S. PATENT DOCUMENTS 3,334,269 8/1967 L'Heureux ..... 315/58

4,053,804 10/1977 Aboelfotoh ..... 315/169.4 X

*Primary Examiner*—Eugene R. La Roche

*Attorney, Agent, or Firm*—Joseph J. Connerton

[57] ABSTRACT

A D.C. gaseous discharge display panel operated in a storage mode uses a layer of resistive material over the cathodes of the display. In addition to protecting the electrodes from ion bombardment induced sputtering during discharge, the material provides a resistance to each discharge cell, provides isolation between individual cathodes by reducing discharge spreading along the cathode conductors and prevents surface charge building during panel operation. By utilizing a combination of metal and insulator in the resistance layer, the D.C. discharge can be sustained at lower operating voltage, permitting a reduction in the power requirements of the panel.

9 Claims, 4 Drawing Figures

DC GAS DISCHARGE DISPLAY PANEL WITH INTERNAL MEMORY

CROSS REFERENCE TO RELATED APPLICATION

Application Ser. No. 37,082 "D C Scan Panel" filed May 8, 1979 by M. O. Aboelfotoh, now U.S. Pat. No. 4,297,613, is directed to a D.C. Scan Panel without refresh.

BACKGROUND OF THE INVENTION

The present invention relates to gas discharge display panels with internal memory and, more particularly, to such display panels which operate in a DC mode.

Gas discharge display panels in which two orthogonal sets of conductors are disposed on opposite sides of an ionizable gas are well known in the art. In such devices, a potential applied to one of the anodes and one of the cathodes will result in the breakdown of the gas at the intersection of those electrodes, and the resulting gas discharge will emit light in the visible region of the spectrum.

In AC gas discharge display panels, the electrodes are isolated from the gas by a dielectric. This dielectric capacitor acts as the memory element of the cells and also provides the current limiting mechanism. During each half-cycle of the AC excitation signal, a wall charge will build up on the surface of the dielectric in contact with the gas, and this wall charge will oppose the drive signal, permitting use of lower voltage signals to sustain or maintain the discharge. This is advantageous in an AC gas discharge display panel since the wall charge will rapidly extinguish the gas discharge and assist in breaking down the gas during the next half-cycle of the AC signal. Since each breakdown during each half-cycle of operation produces light emission from the selected cell or cells, a flicker-free display can be achieved by operating the display at a relatively high frequency, e.g., 30–50 kilocycles. A disadvantage of AC gas discharge display panels is that the AC drive signal generation systems are quite expensive and the brightness and efficiency are low.

An alternative to the AC gas discharge display panel is a DC gas discharge panel which, like the AC panel, consists of two sets of orthogonally arranged conductors enclosing an ionizable gas. In conventional DC operated gas discharge display panels, the metal electrodes are in direct contact with the discharge. Therefore, the cathodes are subjected to constant bombardment by gas ions during DC operation. These gas ions may have sufficient kinetic energy to sputter atoms from the cathode surface. While many of the sputtered atoms will be deflected by collisions with gas atoms, some will escape collision with the gas atoms and be deposited on other surfaces within the device. Continued sputtering will result in the production of electrical leakage paths between conductors and in the trapping of inert gas by sputtered deposits, with consequent loss of gas pressure. These sputtering effects will restult in a decrease in the usable life of the device and they will also make cell switching more difficult.

Certain techniques have been proposed to control sputtering of the cathodes in a DC gas-discharge display panel, but none have proven satisfactory. If a protective layer overlying the cathodes is employed in a DC panel, such a layer cannot be a dielectric protective layer, since a dielectric will isolate the gas discharge cell from the DC excitation voltage. In contrast to the AC panel, in which a surface charge build-up is desirable in order to aid in extinguishing the discharge and in causing gas breakdown during the next half cycle of operation, a surface charge build-up in a DC operated panel will decrease the effective potential applied to the gas until the net voltage falls below the minimum voltage required to sustain a gas discharge, at which time the cell will turn "off".

A somewhat similar problem has also been recognized in AC gas discharge display panels. In AC panels, the dielectric glass layer overlying the metal electrodes and isolating them from the gas can become dissociated and sputtered due to ion bombardment from the discharge. Therefore, the dielectric glass layer in AC panels is covered with a protective refractory layer made of a material having a high binding energy such as magnesium oxide. In DC gas discharge display panels, on the other hand, a protective dielectric layer of a high binding energy metal oxide such as magnesium oxide overlying the metal cathodes cannot be employed to correct cathode sputtering, since any surface charge build-up is undesirable in DC operation.

For DC gas discharge display panels operated in a storage mode, a current limiting element, usually a resistor, must be used in series with each cell to increase the overall impedance of the cell, since the impedance of the cell due to discharge alone is generally low. This gives the cells internal memory and, once the cells are switched on, the discharges can be sustained by a fixed DC voltage until erasure is required. Certain proposals have been made for producing internal resistors in DC panels with internal memory, but none have proven satisfactory.

SUMMARY OF THE INVENTION

Accordingly, it is an object of the present invention to provide a DC discharge display panel with internal memory in which the metal electrodes are isolated from the discharge by one or more layers of a resistive material composed of a mixture of a metal and an insulator, or by a layer of a semiconducting material overcoated with such a resistive layer. Such layers provide a uniform and stable resistor in series with each discharge cell, in addition to protecting the metal cathodes from ion bombardment induced sputtering. Briefly, the cathode electrodes in a DC gas discharge display panel with internal memory are covered with one or more of the above described layers. In the resistive layer, the amount of metal incorporated into the insulator is such that surface charge build-up during DC operation is prevented, while the layer provides sufficient resistance in series with each discharge cell. In this way, a uniform and stable resistor will be internally produced, while providing isolation between individual cathodes as well as protection from ion bombardment. Further the high surface resistivities of the layers will tend to eliminate discharge spreading along the metal conductors, thus eliminating the necessity of physical barriers between adjacent discharge cells which are commonly provided in known DC gas discharge display panels.

DETAILED DESCRIPTION OF THE INVENTION

Figure 1:
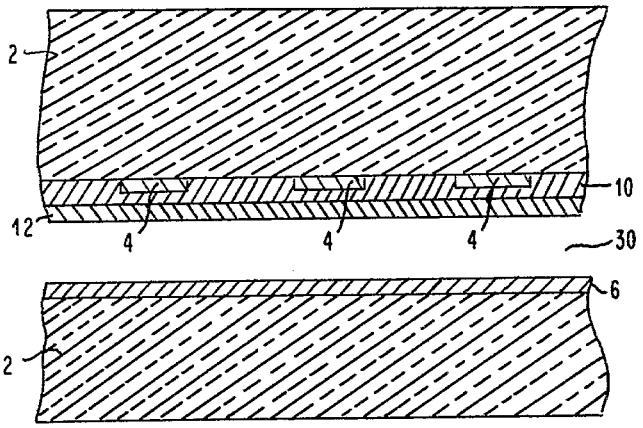
FIG. 1 is a side sectional view of a portion of a DC gas discharge display panel according to the present invention.

In the DC gas discharge display panel, according to the present invention, cathode and anode electrodes 4 and 6, respectively, are applied to or formed on plate glass substrates 2 as shown in FIG. 1. The cathode electrodes are then isolated from the discharge by one or more layers 10 and 12 of resistive material consisting of mixtures of metals such as chromium, nickel, gold or silver and insulators such as silicon dioxide ($SiO_2$) or magnesium oxide (MgO). The metal is incorporated into the insulator to increase the electrical conductivity of the layers to the extent that surface charge cannot develop during the DC operation of the discharge cell. The cathode electrodes 4 are thus protected from ion bombardment by protective layers which are capable of neither electrically shorting out adjacent cathode electrodes because of their relatively high sheet resistivity nor permitting build-up of surface charge during DC operation. Further, the gas contacting layer 12 over the cathodes can be made of a mixture of an insulator such as MgO and a metal such as nickel, gold or silver to produce high secondary electron emission, thus permitting the DC discharge to be sustained at lower operating voltages. This will result in a reduction in the power requirements of the gas discharge panel.

In fabricating the panel shown in FIG. 1, the cathode electrodes 4 are first covered with a resistive layer 10 consisting of a mixture of a metal such as chromium and an insulator such as $SiO_2$. The layer 10 is then overcoated with a layer 12, the latter consisting of a mixture of a metal such as nickel, gold or silver and an insulator such as MgO. The gas contacting layer 12 should contain between 15%–50% of nickel by volume, for example, and should have a thickness range of 100 to 10,000 Angstroms. The metal content and the thickness of the layers 10 and 12 are chosen such that sufficient resistance is provided to limit the cell current, while exhibiting enough conductivity to prevent the build-up of surface charge during operation. Since the secondary electron emission properties of the gas contacting layer 12 are determined by the surface MgO concentration, the presence of a metal such as nickel lowers the secondary electron emission coefficient of layer 12, thus further limiting the cell current when the cell is in the on-state. A suitable level of cell sustaining current may be approximately 10 to 30 microamperes. The metal and insulating layer such as layer 12 used to lower the operating voltage are designated as cermet layers to distinguish them from the resistance or semiconductor layers which are also composed of metals and insulators.

The metal metal-oxide layers 10 and 12 are applied to the surfaces of the plate glass substrates 2 by any convenient means including not by way of limitation co-evaporation of the metals and insulators using direct heat and electron beam; and co-sputtering the metals and insulators by various techniques such as simultaneously DC sputtering the metal and r.f. sputtering the insulator or r.f. sputtering mixtures of the metals and insulators.

In the panel shown in FIG. 1, the cathode and anode electrodes 4 and 6, respectively, are formed on plate glass substrates 2 by a number of well known processes such as sputtering, vacuum deposition, photo etching, etc. Suitable electrodes would be 1,000–10,000 Angstroms of gold, aluminum or nickel. Transparent conductive material such as indium-tin oxide can be used to form the anode electrodes 6, and should have a resistance of less than 5,000 ohms per line. The preferred thickness of the ionizable gas layer or discharge gap 30 is about 4 to 8 mils, with anode and cathode arrays having a center-to-center spacing of about 20 mils.

Figure 2:
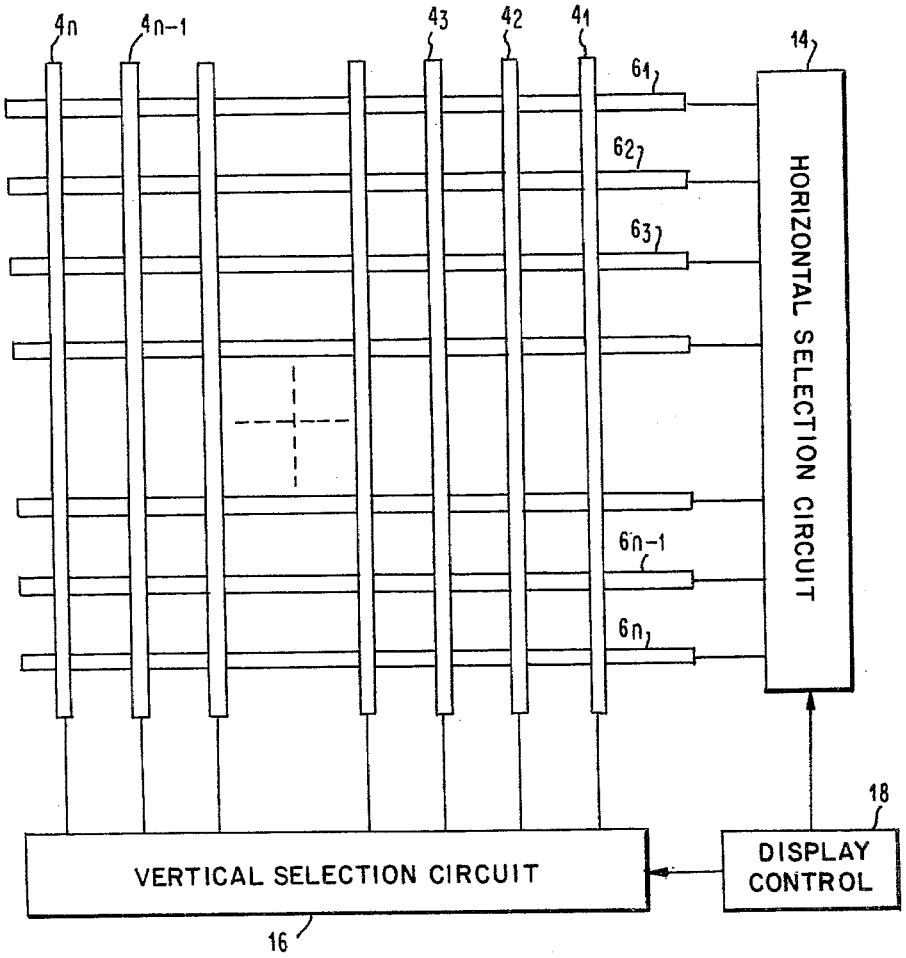
FIG. 2 is a diagram illustrating the basic operation of the gas discharge panel according to the present invention.

FIG. 2 illustrates the basic technique for activating or driving the DC gas discharge display panel. In a DC gas discharge display panel of the type shown schematically in FIG. 1, a firing voltage $V_f$ is required to initiate the breakdown of the gas. After initiation of the discharge, the cell voltage, i.e., the voltage across the discharge gap 30 and resistor, can be reduced without extinguishing the discharge. At some point, determined primarily by the value of the cell resistance, the voltage reaches an extinguishing voltage $V_e$, at which level the illumination resulting from the gas discharge ceases. Voltage thresholds typical of a DC gas discharge panel using a neon-argon Penning gas mixture, operated at a pressure of about 300 Torr and having 4 mil wide electrodes on 30 mil center-to-center spacings and a 4 mil discharge gap are a firing voltage $V_f$ of approximately 135 volts, an extinguishing voltage $V_e$ of approximately 115 volts, with a DC voltage level $V_s$ of approximately 120–125 volts being sufficient to sustain the discharge once initiated.

The gas discharge display panel is addressed by selectively applied voltage pulses superimposed on the DC sustaining voltage $V_s$. In order to write a selected intersection, voltage pulses $V_w$ are applied to the selected anode and the selected cathode in addition to the DC sustain voltage $V_s$ between the anodes and cathodes. In this way, the cell at the selected intersection receives a voltage increment of 2 $V_w$, equal to or exceeding $V_f$ max$-V_s$, to implement a write operation. Cells at non-selected intersections receive the half select pulses of amplitude $V_w$ which must be kept less than $V_f$min$-V_s$ to avoid unwanted writing. It should be noted that $V_f$ max and $V_f$min define the boundary conditions of the firing voltage spread. Similarly, to erase a selected intersection, voltage pulses $V_e$ are applied to the selected anode and the selected cathode such that the cell at the selected intersection receives a voltage increment of 2 $V_e$. The signal level 2 $V_e$ must exceed $V_s-V_e$ min in order to implement an erase operation. Cells at non-selected intersections receive the half-select pulses of amplitude $V_e$ which must be kept less than $V_s-V_e$ max to avoid non-selected erasing. $V_e$max and $V_e$min define the boundary conditions of the spread of the extinguishing voltage.

For a firing voltage $V_f$ of 135 volts and an extinguishing voltage $V_e$ of 115 volts, the DC sustaining voltage $V_s$ continuously applied to the anodes $6_1$, $6_2$ . . . $6_n$ through the horizontal selection circuit 14 can be 125 volts, with the selection circuit 14 being capable of imposing an additional plus or minus 5 volt pulses on the 125 volt sustaining voltage in response to information form a display control 18. The vertical selection circuit 16 can apply a reference level such as ground potential to the cathodes $4_1$, $4_2$ . . . $4_n$, and also be capable of selectively applying plus or minus 5 volt pulses to the cathodes in response to information provided by a display control. In order to initiate gas discharge at the intersection of, for example, anode $6_1$ and cathode $4_1$, the horizontal selection circuit 14 will apply an additional +5 volt pulse to anode $6_1$ while maintaining anodes $6_2$, $6_3$ . . . $6_n$ at the 125 volt sustaining level. These pulses can be, for example, approximately 100–150 microseconds in duration. Vertical selection circuit 16 will then apply a −5 volt pulse to cathode $4_1$ while maintaining cathodes $4_2$, $4_3$ . . . $4_n$ at ground potential. Intersections $6_1$-$4_2$ . . . $6_1$-$4_n$ will be subject to a total potential difference of 130 volts, a potential which is insufficient to initiate gas discharge. Intersection $6_1$-$4_1$ will be subject to a 135 volt potential and discharge will occur. Energization of selected intersections on the $6_2$, $6_3$ . . . or $6_n$ anode will be implemented in the same fashion. It should be noted that during energization of selected intersections on the $6_2$ anode, the $6_1$ anode is maintained at a potential of 125 volts. Since all of the cathodes are maintained at either 0 or minus 5 volt levels, the potential difference at each of the intersections along the $6_1$ anode will either be 120 or 125 volts, sufficient to sustain the discharges along anode $6_1$ once initiated.

In order to erase selected intersections, the horizontal selection circuit 14 applies to selected anode $6_1$ a −5 volt erase pulse, while the vertical selection circuit 16 applies to selected cathode $4_1$ a +5 volt erase pulse. The potential at the intersection of selected anode $6_1$ and cathode $4_1$ is only 115 volts, thus extinguishing the discharge. At all non-selected intersections, the potential difference will remain at 120 volts and existing discharges will be sustained.

The above description of the "memory" mode of operation of the DC gas discharge display panel according to the present invention is given by way of example only. The firing and extinguishing voltages of the gas discharge cells should be determined empirically, and the DC sustaining voltage and the amplitudes of the write and erase pulses applied from the horizontal and vertical selection circuits should be specified according to the empirically determined characteristics of the cells. For example, it may be that the gas discharge cells have an extinguishing voltage of 110 volts rather than 115 volts and the DC sustaining voltage and the amplitudes of the write and erase pulses will then have to be altered accordingly.

Further, the details of the display control, horizontal selection circuitry and vertical selection circuitry do not constitute a part of the present invention and need not be described herein. The circuitry necessary to operate the DC gas discharge display panel according to the present invention would be obvious to one of ordinary skill in the art.

The use of the present invention provides many advantages. For example, layers consisting of mixtures of metals and insulators are used to provide stable and uniform resistors in series with each discharge and to protect the metal cathodes from ion bombardment induced sputtering. The high secondary electron emission coefficients of the gas contacting layers result in a lower DC voltage being required in order to sustain the discharges. Further, display panels fabricated according to the present invention, exhibit small spreads in values of both the firing and extinguishing voltages thus ensuring small write and erase pulses.

Figure 3:
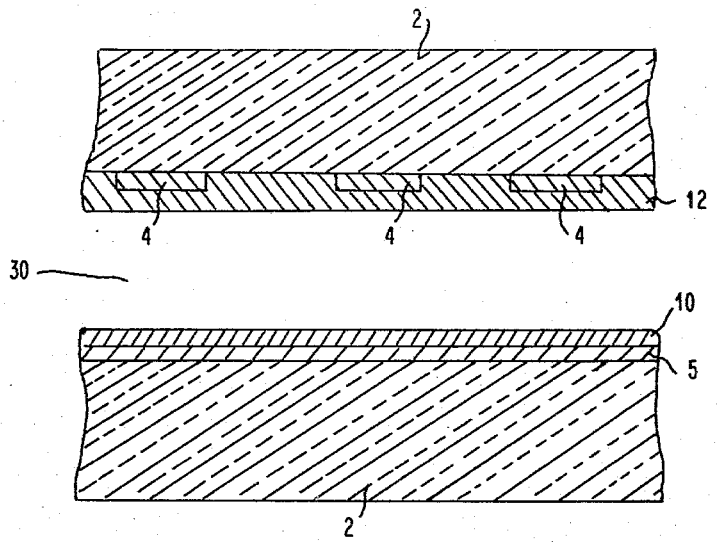
FIG. 3 is a side sectional view of a modification of the gas discharge panel shown in FIG. 1.
Figure 4:
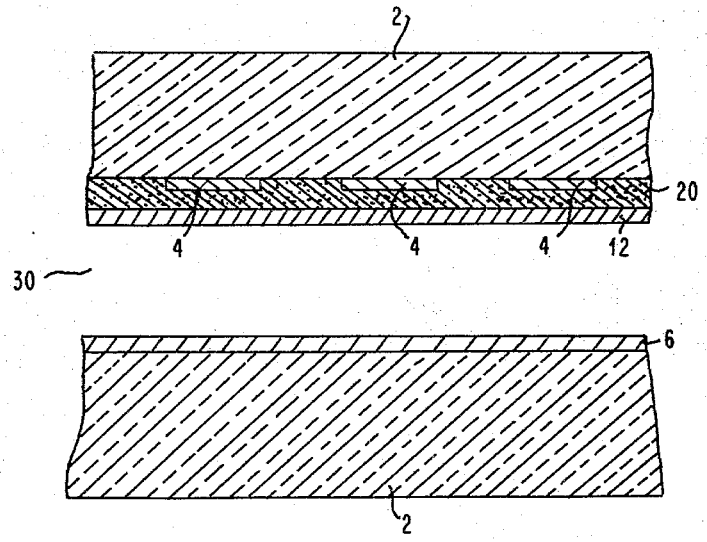
FIG. 4 is a side sectional view of an alternative modification of the gas discharge panel shown in FIG. 1.

FIGS. 3 and 4 show further alternatives embodiment of the DC gas discharge panel according to the present invention. In FIG. 1, only the cathodes are covered with more than one layer consisting of mixtures of metals and insulators. In FIG. 3, the anodes are covered with a resistive layer 10 consisting of a mixture of a metal such as chromium and an insulator such as silicon dioxide, ($SiO_2$) while the cathodes are isolated from the discharge by a layer 12 consisting of a mixture of a metal such as nickel, gold or silver and an insulator having a high secondary electron emission coefficient such as magnesium oxide (MgO). The amount of metal incorporated into the insulator is such that the layers exhibit enough conductivity to prevent the build-up of positive or negative surface charge, yet exhibit sufficient resistance to limit the cell current in the "on" state. A suitable level of cell current may be approximately 10–30 microamperes at the sustaining voltage level. In manufacturing the gas discharge display panel, according to the present invention, anodes 6 and cathodes 4 are first formed on plate glass substrates 2. A layer 10 which consists of a mixture of a metal such as chromium and an insulator such as $SiO_2$ is then deposited over the anodes 6 and a layer 12 consisting of a mixture of a metal such as nickel, gold or silver and an insulator such as MgO is deposited over the cathodes 4. The layer 10 should be approximately 20–50% by volume, for example, chromium and should have a thickness of 1,000 to 10,000 Angstroms, depending upon the value of resistance desired. The layer 12 should be approximately 15–50 percent by volume nickel or gold and should have a thickness range of 100 to 10,000 Angstroms.

In FIG. 4, only the cathodes are isolated from the discharge by at least two layers 12 and 20. Layer 12 consists of a mixture of a metal and an insulator, while layer 20 is made of a semiconducting material such as tin oxide. In fabricating the gas discharge panel according to the present invention, anodes 6 and cathodes 4 are first deposited on plate glass substrates 2, layer 20 is then deposited over the cathodes by a number of well known processes, such as r.f. sputtering, d.c. sputtering, vacuum deposition and reactive deposition using an electron beam. The thickness of layer 20 should be approximately 1,000–20,000 Angstroms depending upon the resistance value desired to limit the cell current. Layer 20 is, in turn, overcoated with layer 12 which consists of a mixture of a metal such as nickel, gold or silver and an insulator such as MgO. Layer 12 should be approximately 15–50 percent by volume nickel (or gold) and should have a thickness of 100–10,000 Angstroms. Such layers exhibit enough conductivity to prevent the build up of positive surface charge during DC operation, yet exhibit enough resistance to isolate adjacent cathodes from one another. Not only is sputtering of the cathodes prevented by such layers, but the high secondary electron emission coefficient of the gas contacting layer 12 results in a lower DC voltage being required in order to sustain the discharge. Further the high surface resistivity of the layer 12 tends to concentrate the discharge in the immediate vicinity of each electrode intersection, thus eliminating the need for structure for separating adjacent cells, e.g., aperture plates or grooved panel structures.

While the invention has been shown and described with reference to a preferred embodiment thereof, it will be understood that various substitutions in form and detail may be made by those skilled in the art without departing from the spirit and scope of the invention.

Having thus described my invention, what I claim as new, and desire to secure by Letters Patent is:

1. A D.C. gaseous discharge display device with internal memory comprising in combination, an ionizable gaseous medium in a gas chamber formed by a pair of glass plates, a parallel cathode conductor array disposed on one of said glass plates, a parallel anode conductor array disposed on the other of said pair of glass plates, said first and second conductor arrays being disposed substantially orthogonal to each other, the intersections of said cathode and anode conductors defining gas discharge cells, a layer of resistive material overlying one of said conductor arrays to provide a uniform and stable resistance to and to limit the current through each of said cells during discharge of said gaseous discharge display device, and a cermet layer overlying the other of said conductors arrays.

2. A device of the character claimed in claim 1 wherein said resistive material layer overlies said anode conductor array.

3. A device of the character claimed in claim 2 wherein said resistive material layer has sufficient conductivity to prevent the buildup of surface charge during operation of said gaseous discharge display device.

4. A device of the type claimed in claim 3 wherein said layer of resistive material consists of a mixture of a metal and an insulator.

5. A device of the type claimed in claim 4 wherein said metal is chromium, nickel, gold, silver or combinations thereof.

6. A device of the type claimed in claim 4 wherein said insulator is silicon dioxide, magnesium oxide or compounds thereof.

7. A device of the type claimed in claim 2 wherein said resistive material layer is composed of semiconductor material.

8. A device of the character claimed in claim 7 wherein said layer of semiconductor material is disposed over said anode array.

9. A device of the type claimed in claim 1 wherein said cermet layer overlies said cathode conductors.

* * * * *